US005912530A

United States Patent [19]

Misono et al.

[11] Patent Number: 5,912,530

[45] Date of Patent: Jun. 15, 1999

[54] COLOR CATHODE RAY TUBE WITH COMA REDUCED

[75] Inventors: Masayoshi Misono, Chousei-gun; Hiroyuki Tamura; Tsutomu Tojyo, both of Mobara, all of Japan

[73] Assignees: Hitachi, Ltd., Tokyo; Hitachi Device EngineeringCo., Ltd., Mobara, both of Japan

[21] Appl. No.: 08/914,150

[22] Filed: Aug. 19, 1997

[30] Foreign Application Priority Data

Sep. 4, 1996 [JP] Japan ..... 8-234381

[51] Int. Cl.[6] ..... H01J 29/70

[52] U.S. Cl. ..... 313/412; 313/431; 313/428

[58] Field of Search ..... 313/412, 431, 313/428

[56] References Cited

U.S. PATENT DOCUMENTS

| | | | |
|---|---|---|---|
| 3,952,224 | 4/1976 | Evans, Jr. | 313/409 |
| 4,086,513 | 4/1978 | Evans, Jr. | 313/414 |
| 5,512,802 | 4/1996 | Jumar | 315/368.25 |
| 5,770,932 | 6/1998 | Nakane | 313/412 |

*Primary Examiner*—Nimeshkumar D. Patel
*Attorney, Agent, or Firm*—Antonelli, Terry, Stout & Kraus, LLP

[57] ABSTRACT

A color cathode ray tube includes a vacuum envelope formed by a panel, neck and funnel portions. The cathode ray tube includes a phosphor screen, a shadow mask, an electron gun and a deflection device. The cathode ray tube further includes a convergence correction device having a plurality of magnetic pieces positioned on opposite sides of each of the three electron beams in an in-line direction of the electron beams in a magnetic deflection fields generated by the deflection device. The plurality of magnetic pieces include a first pair of magnetic pieces positioned on a neck wall side of each of side electron beams in the in-line direction and a second pair of magnetic pieces positioned on opposite sides of a center electron beam of the three electron beams in the in-line direction. The plurality of magnetic pieces are configured so as to locally modify the magnetic deflection fields to make three rasters formed on the phosphor screen by the three electron beams coincident with each other. The first pair of magnetic pieces have a portion of an axial length greater than an axial length of the second pair of magnetic pieces, where the axial lengths is measured in a plane containing the in-line direction and a longitudinal axis of the cathode ray tube.

14 Claims, 13 Drawing Sheets

FIG. 5
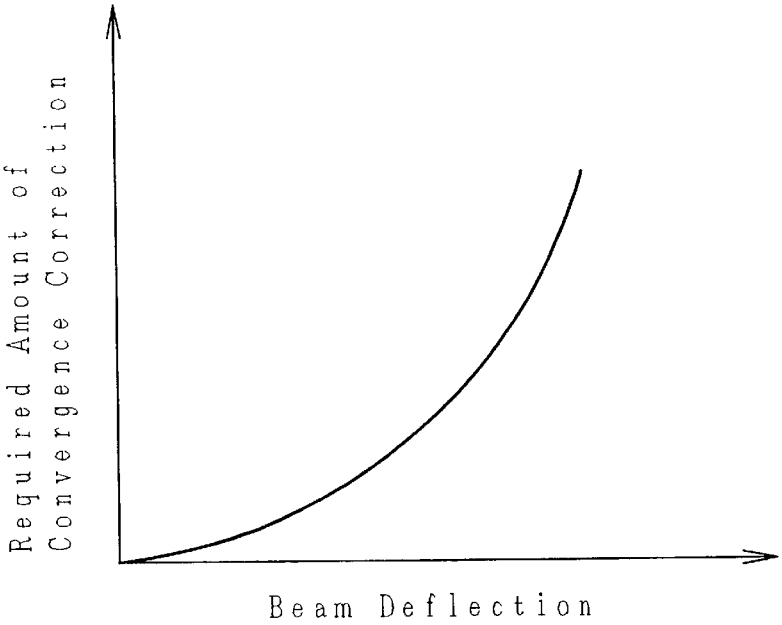
FIG. 6A
FIG. 6B
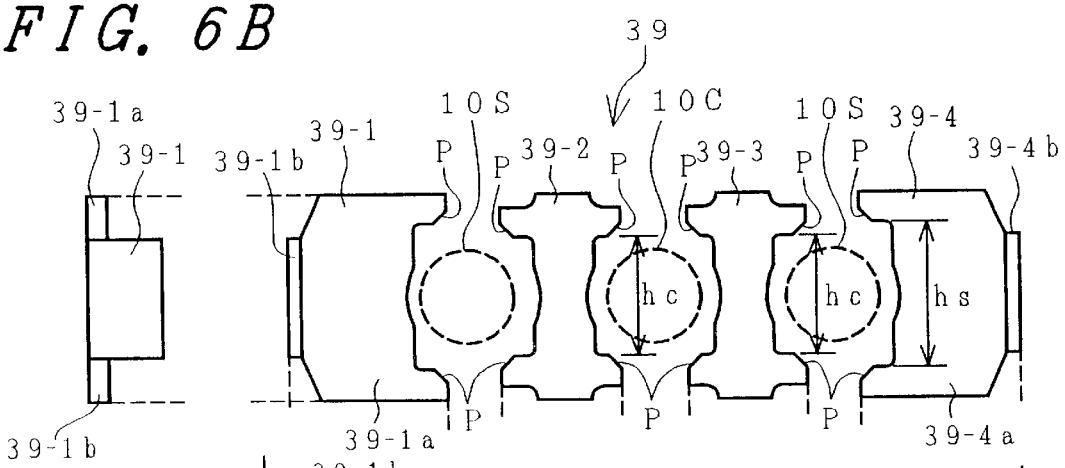
FIG. 6C
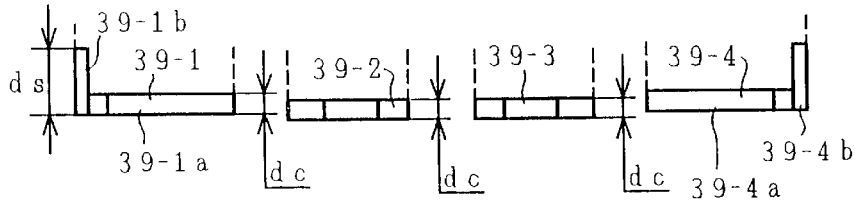

FIG. 7A
FIG. 7B
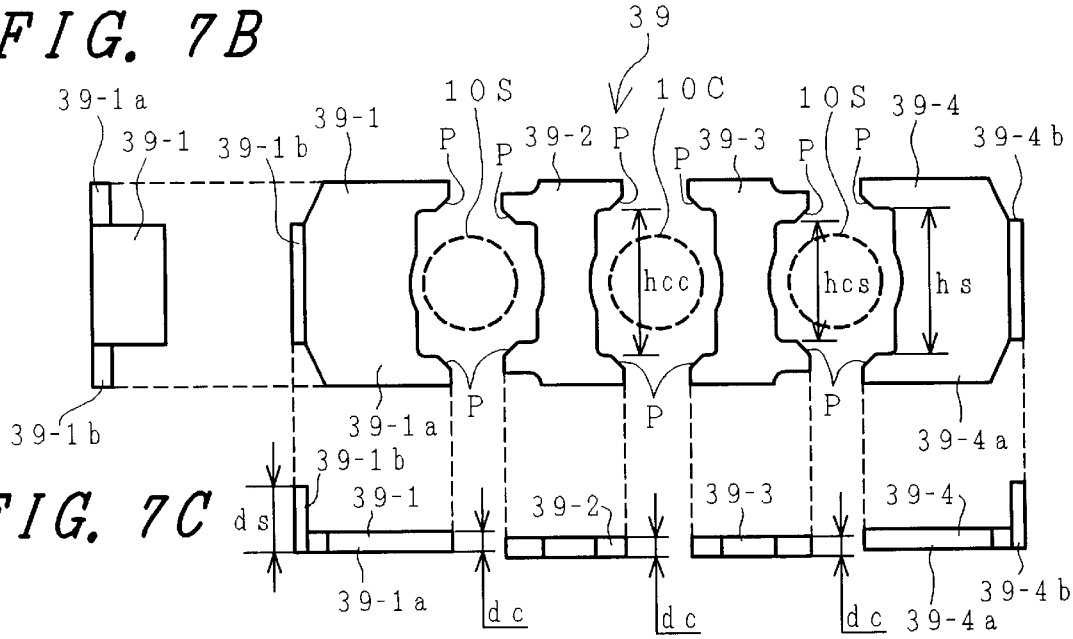
FIG. 7C
FIG. 8A
FIG. 8B
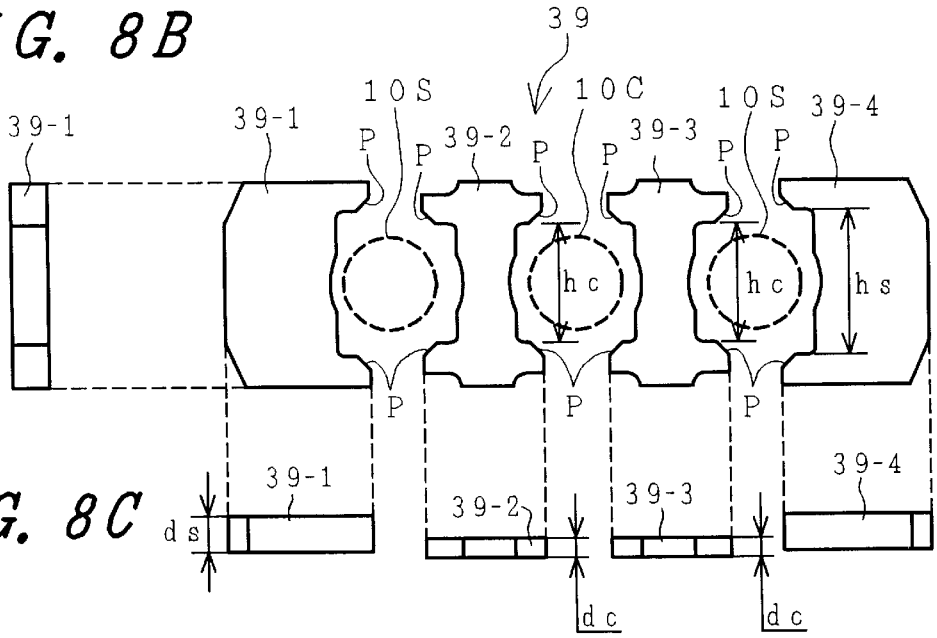
FIG. 8C

FIG. 9A
FIG. 9B
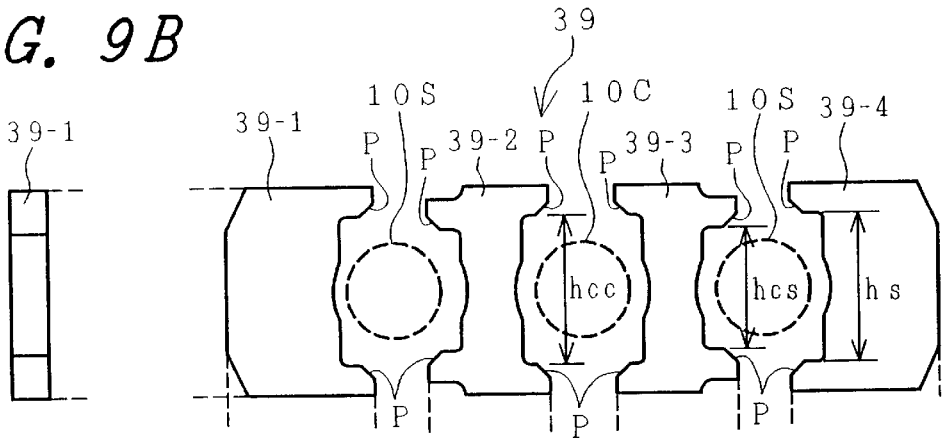
FIG. 9C
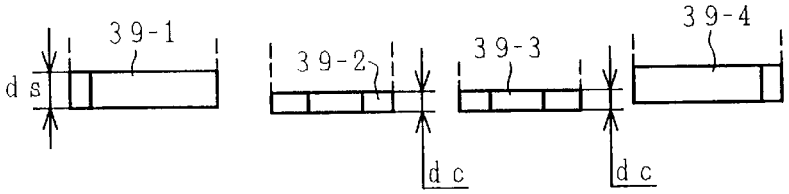
FIG. 10A
FIG. 10B
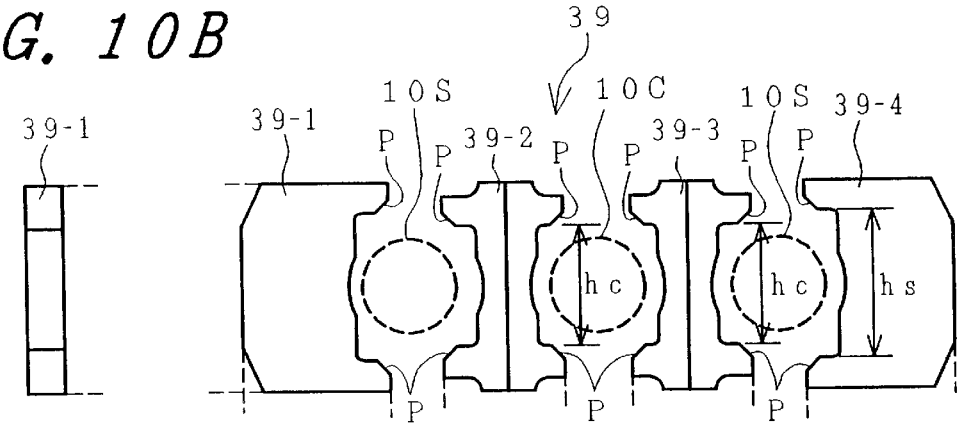
FIG. 10C
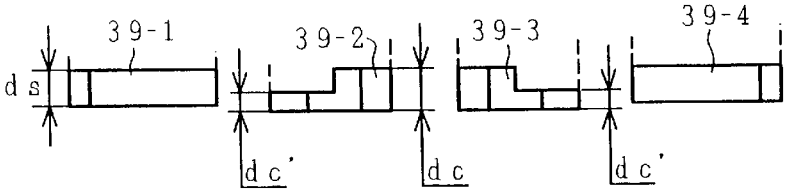

COLOR CATHODE RAY TUBE WITH COMA REDUCED

BACKGROUND OF THE INVENTION

The present invention relates to a color cathode ray tube in which the amounts of horizontal and vertical deflection of a plurality of electron beams is individually controlled to correct coma caused by a deflection magnetic field, and convergence errors of the plurality of electron beams are suppressed to thereby obtain a good image display over the entire phosphor screen.

In a color cathode ray tube having at least an electron gun comprising a plurality of electrodes, a deflection device, and a phosphor screen (a screen having a phosphor film, hereinafter also referred to as a phosphor film or merely referred to as a screen), the following techniques have been known as means for reproducing a good image over the entire phosphor screen.

Japanese Patent Publication No. Hei 4-52586 discloses an electron gun emitting three inline electron beams in which a pair of parallel flat electrodes are disposed on the bottom face of a shield cup in such a manner as to be positioned above and below paths of the three electron beams in parallel to the inline direction and to extend toward a main lens.

U.S. Pat. No. 4,086,513 and its corresponding Japanese Patent Publication No. Sho 60-7345 disclose an electron gun emitting three inline electron beams in which a pair of parallel flat electrodes are disposed above and below paths of the three electron beams in parallel to the inline direction in such a manner as to extend from one of facing ends of one of a pair of main-lens-forming electrodes toward a phosphor screen, thereby shaping the electron beams before the electron beams enter a deflection magnetic field.

Japanese Patent Laid-open No. Sho 51-61766 discloses an electron gun in which an electrostatic quadrupole lens is formed between two electrodes and the strength of the electrostatic quadrupole lens is made to vary dynamically with the deflection of an electron beam, thereby achieving uniformity of an image over the entire screen.

Japanese Patent Publication No. Sho 53-18866 discloses an electron gun in which an astigmatic lens is provided in a region between a second grid electrode and a third grid electrode forming a prefocus lens.

U.S. Pat. No. 3,952,224 and its corresponding Japanese Patent Laid-open No. Sho 51-64368 discloses an electron gun emitting three inline electron beams in which an electron beam aperture of each of first and second grid electrodes is formed in an elliptic shape, and the degree of ellipticity of the aperture is made to differ for each beam path or the degree of ellipticity of the electron beam aperture of the center electron gun is made smaller than that of the side electron gun.

Japanese Patent Laid-open No. Sho 60-81736 discloses an electron gun emitting three inline electron beams in which a slit recess provided in a third grid electrode on the cathode side forms a non-axially-symmetrical lens, and an electron beam is made to impinge on the phosphor screen through at least one non-axially-symmetrical lens in which the axial depth of the slit recess is larger for the center beam than for the side beam.

Japanese Patent Laid-open No. Sho 54-139372 discloses a color cathode ray tube having an electron gun emitting three inline electron beams in which a soft magnetic material is disposed in fringe portions of the deflection magnetic field to form a pincushion-shaped magnetic field for deflecting the electron beams in the direction perpendicular to the inline direction of each electron beam, thereby suppressing a halo caused by the deflection magnetic field in the direction perpendicular to the inline direction.

FIG. 18 is a fragmentary sectional view showing an example of an electron gun for a color cathode ray tube using three in-line electron beams.

In FIG. 18, reference numeral 1 designates a first grid electrode (G1), 2 a second grid electrode (G2), 3 a third grid electrode (G3), 4 a fourth grid electrode (G4), 5 a fifth grid electrode (G5), 6 a sixth grid electrode (G6), 30 a shield cup, 38 a main lens, and K a cathode.

In this electron gun, the fifth grid electrode 5 is a focus electrode, the sixth grid electrode 6 is an anode, and the shield cup 30 is connected to the sixth grid electrode 6. In a cathode ray tube, the shield cup 30 is directed toward the phosphor screen.

FIGS. 19A and 19B are schematic sectional views of main parts for comparison of the construction of an electron gun depending upon the manner of applying focus voltages, FIG. 19A shows a fixed focus voltage type, and FIG. 19B shows a dynamic focus voltage type.

The electrode construction of the fixed focus voltage type electron gun shown in FIG. 19A is the same as that shown in FIG. 18, in which the same functional parts as in FIG. 18 are indicated by the same reference numerals.

In the fixed focus voltage type electron gun shown in FIG. 19A, a same focus voltage Vf1 is applied to electrodes 51 and 52 constituting the fifth grid electrode 5 thereof.

On the other hand, in the dynamic focus type electron gun shown in FIG. 19B, different focus potentials Vf1 and Vf2 are applied to two electrodes 51 and 52 constituting the fifth grid electrode 5, respectively. In particular, a dynamic focus voltage dvf superposed on Vf2 is applied to the electrode 52. Further, in the dynamic focus type electron gun, a portion of one electrode extends into the interior of another electrode as indicated at reference numeral 43, which has disadvantages in that its construction is complicated as compared with the electron gun shown in FIG. 19A, the cost is high, and its workability in assembly of the electron gun is inferior.

FIGS. 20A and 20B are explanatory views of focus potentials applied to the electron guns shown in FIGS. 19A and 19B. FIG. 20A shows a focus voltage waveform for the fixed focus voltage type electron gun, and FIG. 20B shows a focus voltage waveform for the dynamic focus voltage type electron gun.

In FIG. 20B, there are a fixed focus voltage Vf1 and a voltage having a waveform of a dynamic focus voltage Vf2 superposed on another fixed focus voltage Vf20. Therefore, in the dynamic focus voltage type electron gun shown in FIG. 19B, two high-voltage lead-in pins are needed at a stem of a cathode ray tube for supplying two focus voltages, and more consideration to insulation from other adjacent stem pins is necessary than in the fixed focus type electron gun. This poses problems in that a socket of a special construction is needed for a cathode ray tube installed in a TV set, and in addition to two fixed focus voltage sources, a dynamic focus voltage generating circuit is necessary, and additional set-up time is required for adjustment of the focus voltages in the assembly line of the TV set.

Further, in the color cathode ray tube provided with the in-line type electron gun of this kind, the center electron gun is on the tube axis, but the side electron guns are offset from the tube axis so that the side electron beams travel a greater distance in the deflection magnetic field than the center electron beam, receive a larger amount of action by the deflection magnetic fields, and create rasters of a horizontally and vertically larger size on the phosphor screen than the central beam.

As a result, the rasters created by three electron beams are not coincident with each other on the phosphor screen, resulting in convergence errors.

Further, in the color cathode ray tube of this kind, when the maximum deflection angle of the electron beams is fixed, the larger the size of the phosphor screen, the longer is a distance between the phosphor screen and the main lens of the electron gun, and hence the more is focus characteristics degraded by the mutual space-charge repulsion of electrons in this region.

Accordingly, if the distance between the main lens of the electron gun and the phosphor screen is made shorter with some means, fine electron beams can be obtained as in a cathode ray tube with a small-sized phosphor screen to enhance the resolution of the color cathode ray tube.

The shortening of the distance between the main lens of the electron gun and the phosphor screen increases the deflection defocusing and deteriorate the resolution at the periphery of the screen. Therefore, in the above-described prior art, there requires the measure for further raising the dynamic focus voltage so that the technical and cost-wise burdens on the side of the image display device employing the cathode ray tube such as the increased cost of the driving circuit and the improved high voltage breakdown capacity of a socket for a cathode ray tube.

Further, the depth of the present-day TV sets depends on the overall length of the cathode ray tube, and it is preferably short considering the TV set is a kind of a furniture. Moreover, the short depth of TV sets is preferable in terms of transport efficiency for TV set makers transporting a large number of TV sets.

SUMMARY OF THE INVENTION

It is an object of the present invention to overcome various problems as noted above with respect to prior art and provide a color cathode ray tube having improved beam convergence characteristics over the entire phosphor screen by controlling horizontal and vertical coma caused by deflection magnetic fields.

As means for solving the aforementioned problems, the present invention provides a color cathode ray tube including at least an electron gun comprising a plurality of electrodes and using three in-line electron beams, a phosphor screen and a deflection device, wherein magnetic pieces are disposed in deflection magnetic fields and are configured so as to locally modify the distribution of the magnetic fields whereby the respective amounts of deflection of the three electron beams are adjusted to correct the coma caused by the deflection magnetic fields and to maintain the excellent convergence over the entire screen.

According to an embodiment of the present invention, there is provided a color cathode ray tube including a vacuum envelope comprising a panel portion, a neck portion, and a funnel portion connecting said panel portion and said neck portion; a phosphor screen on an inner surface of said panel portion; a shadow mask suspended closely spaced from said phosphor screen in said panel portion; an electron gun comprising a plurality of electrodes for generating and focusing three in-line electron beams and housed within said neck portion; a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device; said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction; and said plurality of magnetic pieces being configured so as to locally modify said magnetic deflection fields and to make three rasters formed on said phosphor screen by said three electron beams coincident with each other; and said first pair of magnetic pieces having a portion of an axial length greater than an axial length of said second pair of magnetic pieces, said axial lengths being measured in a plane containing said in-line direction and a longitudinal axis of said color cathode ray tube.

According to another embodiment of the present invention, there is provided a color cathode ray tube including a vacuum envelope comprising a panel portion, a neck portion, and a funnel portion connecting said panel portion and said neck portion; a phosphor screen on an inner surface of said panel portion; a shadow mask suspended closely spaced from said phosphor screen in said panel portion; an electron gun comprising a plurality of electrodes for generating and focusing three in-line electron beams and housed within said neck portion; a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device; said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction; and said plurality of magnetic pieces being configured so as to locally modify said magnetic deflection fields and to make three rasters formed on said phosphor screen by said three electron beams coincident with each other; one of said first pair of magnetic pieces opposing one of said second pair of magnetic pieces, another of said first pair of magnetic pieces opposing another of said second pair of magnetic pieces, tips of said one of said first pair of magnetic pieces being displaced outwardly from tips of said one of said second pair of magnetic pieces in a direction perpendicular to said in-line direction, said tips of said one of said first pair and said tips of said one of said second pair opposing each other, respectively, and tips of said another of said first pair of magnetic pieces being displaced outwardly from tips of said another of said second pair of magnetic pieces in a direction perpendicular to said in-line direction, said tips of said another of said first pair and said tips of said another of said second pair opposing each other, respectively.

According to still another embodiment of the present invention, there is provided a color cathode ray tube including a vacuum envelope comprising a panel portion, a neck portion, and a funnel portion connecting said panel portion and said neck portion; a phosphor screen on an inner surface of said panel portion; a shadow mask suspended closely spaced from said phosphor screen in said panel portion; an electron gun comprising a plurality of electrodes for generating and focusing three in-line electron beams and housed within said neck portion; a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device; said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction; and said plurality of magnetic pieces being configured so as to locally modify said magnetic deflection fields and to make three rasters formed on said phosphor screen by said three electron beams coincident with each other; wherein said first pair of magnetic pieces having a portion of an axial length greater than a thickness of said second pair of magnetic pieces, said axial length being measured in a plane containing said in-line direction and a longitudinal axis of said color cathode ray tube.

As described above, according to the present invention, there is provided a color cathode ray tube of the type including at least an electron gun using three in-line electron beams and comprising a plurality of electrodes, a deflection device, a color selection electrode, and a phosphor screen, wherein, to correct convergence errors caused by deflection-induced aberration corresponding to the amount of deflection and mainly comprising coma, magnetic pieces are disposed in deflection magnetic fields generated by the deflection device, and are configured so as to have a function of adjusting the respective amounts of deflection of a central electron beam and side electron beams, and the color cathode ray tube of the present invention can achieve an excellent beam convergence over the entire phosphor screen even when it is operated in combination with a deflection yoke having no coma-correcting function.

Further, it is possible to provide a cathode ray tube which can improve the uniformity of resolution over the entire phosphor screen by correcting deflection defocusing corresponding to the amount of deflection, enhance the resolution at the center of the phosphor screen by suppressing the influence of the space charge repulsion with a shortened distance between the phosphor screen and the main lens, can shorten the overall length of the cathode ray tube and can suppress the appearance of moire patterns.

The cathode ray tube of the present invention can make possible a image display device capable of displaying a larger amount of information, reproducing a flicker-less high quality image, and making its cabinet thin.

BRIEF DESCRIPTION OF THE DRAWINGS

In the drawings, which form an integral part of the specification and are to be read in conjunction therewith, and in which like reference numerals designate similar components throughout the figures, and in which:

FIG. 5 is an explanatory view of the relationship between the amount of deflection and the amount of convergence correction;

FIGS. 6A, 6B and 6C are explanatory views of an example of magnetic pieces of a convergence correction device of the color cathode ray tube according to the present invention, FIG. 6A being a front view as viewed from the side of a phosphor screen, FIG. 6B being a side view of the convergence correction device of FIG. 6A perpendicular to the in-line direction of the three electron beams, FIG. 6C being a bottom view as viewed from the bottom side of the convergence correction device of FIG. 6A;

FIGS. 7A, 7B and 7C are explanatory views of another example of magnetic pieces of a convergence correction device of the color cathode ray tube according to the present invention, FIG. 7A being a front view as viewed from the side of a phosphor screen, FIG. 7B being a side view of the convergence correction device of FIG. 6A perpendicular to the in-line direction of the three electron beams, FIG. 7C being a bottom view as viewed from the bottom side of the convergence correction device of FIG. 7A;

FIGS. 8A, 8B and 8C are explanatory views of still another example of magnetic pieces of a convergence correction device of the color cathode ray tube according to the present invention, FIG. 8A being a front view as viewed from the side of a phosphor screen, FIG. 8B being a side view of the convergence correction device of FIG. 6A perpendicular to the in-line direction of the three electron beams, FIG. 8C being a bottom view as viewed from the bottom side of the convergence correction device of FIG. 8A;

FIGS. 9A, 9B and 9C are explanatory views of another example of magnetic pieces of a convergence correction device of the color cathode ray tube according to the present, invention, FIG. 9A being a front view as viewed from the side of a phosphor screen, FIG. 9B being a side view of the convergence correction device of FIG. 6A perpendicular to the in-line direction of the three electron beams, FIG. 9C being a bottom view as viewed from the bottom side of the convergence correction device of FIG. 9A;

FIGS. 10A, 10B and 10C are explanatory views of another example of magnetic pieces of a convergence correction device of the color cathode ray tube according to the present invention, FIG. 10A being a front view as viewed from the side of a phosphor screen, FIG. 10B being a side view of the convergence correction device of FIG. 6A perpendicular to the in-line direction of the three electron beams, FIG. 10C being a bottom view as viewed from the bottom side of the convergence correction device of FIG. 10A;

DETAILED DESCRIPTION OF THE PREFERRED EMBODIMENTS

The embodiments of the present invention will be described in detail hereinafter with reference to the drawings.

Figure 1:
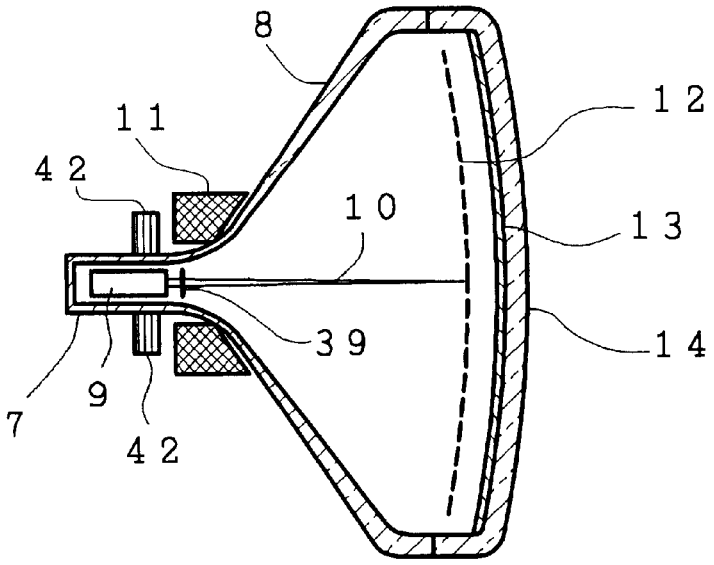
FIG. 1 is a schematic sectional view for explaining an example of a color cathode ray tube using three in-line electron beams for explaining a method for correcting deflection-induced aberration of a color cathode ray tube according to the present invention.

FIG. 1 is a schematic sectional view for explaining an example of a color cathode ray tube using three in-line electron beams for explaining a color cathode ray tube according to the present invention. Reference numeral 7 designates a neck portion, 8 a funnel portion, 9 an electron gun, 10 electron beams, 11 a deflection device (deflection yoke), 12 a color selection electrode (a shadow mask), 13 a phosphor film (hereinafter also referred to as a phosphor screen), 14 a panel portion, and 39 a convergence correction device. In the following, parts having a function similar to those in FIG. 1 are designated by the same reference numerals.

In FIG. 1, the neck portion 7, the funnel portion 8 and the panel portion 14 constitute a vacuum envelope. The electron beams 10 are emitted from and shaped by the electron gun 9, and then are deflected by the deflection device. The deflected electron beams 10 pass through the color selection electrode 12, and impinge upon and excite the phosphor film 13 to luminesce and to form an image.

A convergence correction device 39 comprises magnetic pieces disposed in the deflection magnetic field generated by the deflection device 11 and configured so as to sandwich each of three electron beams in the in-line direction of the three electron beams. The magnetic pieces are further configured such that they modify locally the deflection magnetic fields acting on the center or side electron beams to suppress coma and to achieve a good beam convergence over the entire screen area. The coma-free image thus formed by the three electron beams is viewed through the panel portion 14.

Figure 2:
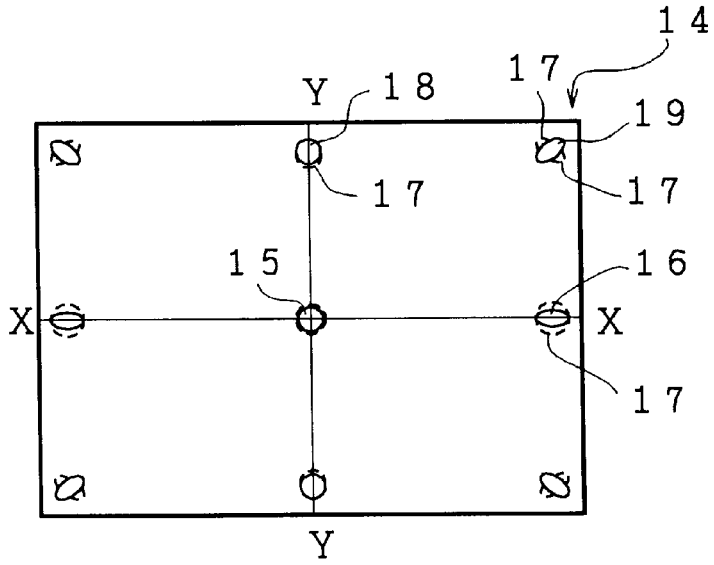
FIG. 2 is an explanatory view of the shapes of the electron beam spots on the phosphor screen of the color cathode ray tube of FIG. 1.

FIG. 2 is an explanatory view of shapes of the electron beam spots on the phosphor screen of the color cathode ray tube of FIG. 1. The panel portion 14 generally has a substantially rectangular external shape, and the phosphor film 13 also has a substantially rectangular shape conforming to the shape of the panel portion 14 and is formed on the inner surface of the panel portion 14. The phosphor film 13 viewed through the panel portion 14 as shown in FIG. 2 is hereinafter called a screen.

Figure 3:
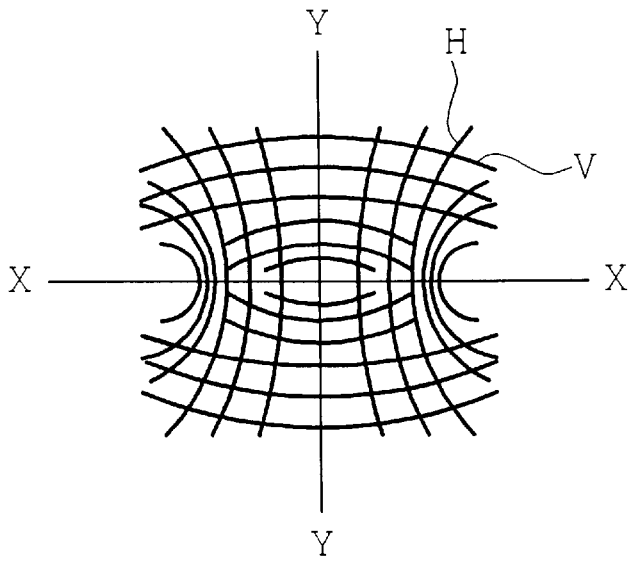
FIG. 3 is an explanatory view of a distribution of deflection magnetic fields generated by the deflection device in the color cathode ray tube of FIG. 1.

FIG. 3 is an explanatory view of a distribution of a deflection magnetic field generated by a deflection device for the color cathode ray tube of FIG. 1. The deflection device 11 generates an alternating magnetic field having a magnetic flux distribution as shown in FIG. 3, scans the electron beams in a direction of the axis X—X of FIG. 2 and also in a direction of the axis Y—Y at a lower speed than that in the X—X direction over the entire phosphor screen 13 to form a raster, and the amount of the electron beam 10 is controlled every moment to form a brightness-varying image on the phosphor screen 13. The locus of the scanning in the direction of the axis X—X is called a scanning line.

In FIG. 3, H denotes magnetic fluxes for deflecting the electron beam in the direction of X—X in FIG. 2 and has a pincushion-shaped distribution, which will be referred to as a horizontal deflection magnetic field. In FIG. 3, V denote magnetic fluxes for deflecting the electron beam in the direction of Y—Y in FIG. 2 and has a barrel-shaped distribution, which will be referred to as a vertical deflection magnetic field. These distributions of deflection magnetic fields are used to simplify or eliminate a convergence control circuit for three electron beams.

FIG. 2 shows bright spots produced on the phosphor screen of the color cathode ray tube using three in-line electron beams. The line X—X of FIG. 2 is a horizontal center line of the screen, and the line Y—Y is a vertical center line the screen. Reference numeral 15 is a beam spot at the center of the screen, and the beam spot is clear in contour and small in diameter. A spot at the right edge of the line X—X of the screen comprises a high brightness portion 16 called a core and a low brightness portion 17 above and below the core which is called a halo, and is elongated horizontally as a whole. A spot at the top of the line Y—Y of the screen comprises a vertically compressed core 18 and a halo 17.

Spots at the corners of the screen has a shape formed by superposing a vertically compressed and horizontally elongated high-brightness core portion 16 on a halo 18, and then rotating them.

On the screen of the actual color cathode ray tube, the shapes of the beam spots are different between the center and the periphery of the screen as shown in FIG. 2, and the resolution is lower at the periphery of the screen as compared with the center of the screen. This phenomenon is called deflection defocusing.

In FIG. 3, the vertical deflection magnetic field V has a barrel-shaped magnetic flux distribution, and the horizontal deflection magnetic field H has a pincushion-shaped magnetic flux distribution. This originally intended to simplify the convergence control circuit.

The vertical deflection magnetic field V has a function of focusing the electron beams vertically with deflection angle of the beams as well as deflecting the electron beams vertically. The fact that the core 18 is vertically compressed and the halo 17 occur as shown in FIG. 2 is mainly due to the action of the vertical deflection magnetic field V which, at the position of the screen, focuses the electron beams vertically before they reach the phosphor screen. Similarly, the core 16 is horizontally elongated mainly due to the action of the horizontal deflection magnetic field H. Generally, the degradation of the resolution at the periphery of the screen mostly results from the vertical deflection magnetic field.

Figure 4:
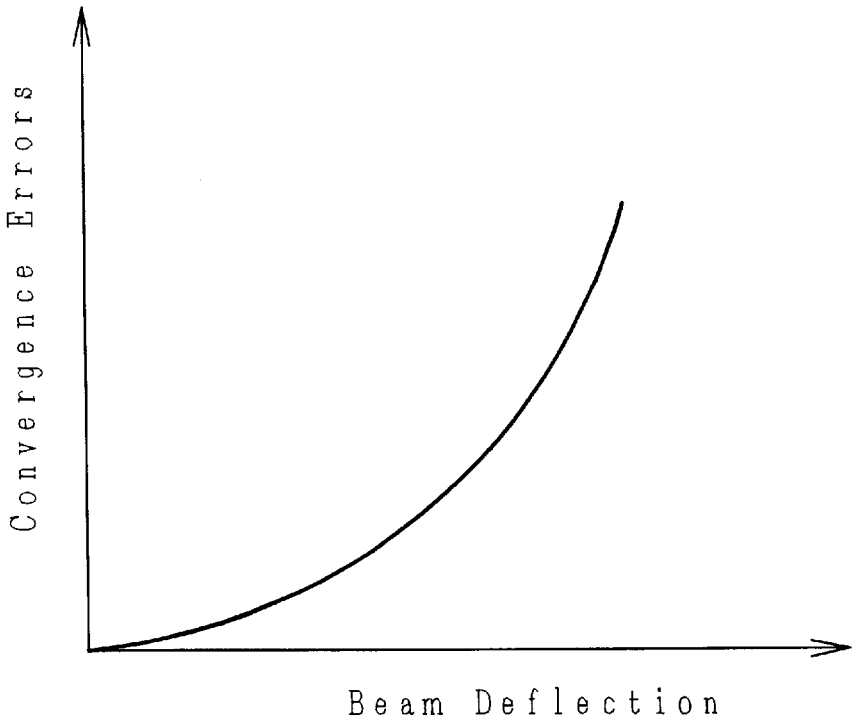
FIG. 4 is an explanatory view of the relationship between the amount of deflection and the amount of deflection-induced aberration.

FIG. 4 is an explanatory view of the relationship between the amount of deflection and the convergence error. As the amount of deflection increases, the amount of convergence error rapidly increases.

FIG. 5 is an explanatory view of the relationship between the amount of deflection and the required amount of convergence correction. In the present invention, the convergence correction device comprising magnetic pieces is provided in the deflection magnetic field of the cathode ray tube to locally modify the deflection magnetic field acting on the three electron beams, respectively, thus suppressing the coma and correcting the convergence errors related to the deflection amount as shown in FIG. 5.

FIGS. 6A, 6B and 6C are explanatory views of an example of magnetic pieces of a convergence correction device of the color cathode ray tube according to the present invention, FIG. 6A is a front view as viewed from the side of the phosphor screen, FIG. 6B is a side view perpendicular to the in-line direction of the three electron beams, and FIG. 6C is a bottom view as viewed from the bottom side of the magnetic pieces of FIG. 6A.

Reference numeral 10S designates a side electron beam of the in-line three electron beams, 10C a center electron beam, 39 a convergence correction device, 39-1, 39-2, 39-3, and 39-4 magnetic pieces, 39-1*a* a base of the outer (on the side of the neck portion) magnetic piece 39-1 associated with the side electron beam, 39-1*b* and 39-4*b* sidepieces of the outer magnetic pieces 39-1 and 39-4 respectively, ds an axial length of the side pieces 39-1*b* and 39-4*b*, dc an axial length of the base 39-1*a* of the magnetic piece 39-1, magnetic pieces 39-2, 39-3, and the base 39-4*a* of the magnetic piece 39-4, hS a distance between the magnetic pole tips at the top and the bottom of the outer magnetic pieces 39-1 and 39-4, respectively, associated with the side beams 10S measured perpendicular to the in-line direction, and hc a distance between the magnetic pole tips at the top and the bottom of the magnetic pieces 39-2, 39-3 associated with the center beam 10C and the outer magnetic pieces 39-1, 39-4 associated with the side beam 10S measured perpendicular to the in-line direction.

In the convergence correction device 39, the axial length ds of the side pieces 39-1*b*, 39-4*b* nearest the neck wall of the outer (on the side of the neck portion) magnetic pieces 39-1, 39-4, respectively, disposed outside the side beams 10S in the in-line direction is made longer than the axial length dc of the bases 39-1*a*, 39-4*a* of the magnetic pieces 39-1, 39-4, respectively, and the magnetic pieces 39-2, 39-3 associated with the center beam.

With this structure, the sensitivity of the horizontal deflection of the side beams is decreased, the amount of deflection of the side beams reduces, and consequently the horizontal coma is made small.

Further, the distance hc between the magnetic pole tips at the top and the bottom of the magnetic pieces 39-2, 39-3 associated with the center beam is made narrower than the distance hs between the magnetic pole tips at the top and the bottom of the magnetic pieces 39-1, 39-4 associated with the side beams to thereby increase the sensitivity of the vertical deflection of the center beam and to improve the deflection action.

Thereby, the raster size of the side beams is made coincident with that of the center beam on the phosphor screen, resulting in good beam convergence over the entire screen.

FIGS. 7A, 7B and 7C are explanatory views of another example of magnetic pieces of a convergence correction device of the color cathode ray tube according to the present invention, the same reference numerals as those in FIGS. 6A to 6C correspond to the same components, FIG. 7A is a front view as viewed from the side of the phosphor screen, FIG. 7B is a side view perpendicular to the in-line direction of the three electron beams, and FIG. 7C is a bottom view as viewed from the bottom side of the magnetic pieces of FIG. 7A.

In the convergence correction device 39, the axial length ds of the side pieces 39-1*b*, 39-4*b* nearest the neck wall of the outer (on the side of the neck portion) magnetic pieces 39-1, 39-4, respectively, disposed outside the side beams 10s in the in-line direction is made longer than the axial length dc of the bases 39-1*a*, 39-4*a* of the magnetic pieces 39-1, 39-4, respectively, and the magnetic pieces 39-2, 39-3 associated with the center beam.

The shape of these magnetic pieces is a modification of the convergence correction device illustrated in FIGS. 6A to 6C,and this modification provides the action making the raster size of the side beams coincident with that of the center beam. The horizontal deflection sensitivity of the side beam is reduced, the amount of deflection is decreased, and consequently the horizontal coma is made small.

Further, a distance hcc between the magnetic pole tips at the top and the bottom of the magnetic pieces 39-2, 39-3, respectively, associated with the center beam is the same as a distance hs between the magnetic pole tips at the top and the bottom of the magnetic pieces 39-1, 39-4 associated with the side beams, and a distance hcs between the magnetic pole tips at the top and the bottom on the side beam sides of the magnetic pieces 39-2 and 39-3, respectively, is made narrower than the hc and hs, and thus the vertical deflection sensitivity of the side beams decreases.

Thereby, the raster size of the side beams is made coincident with that of the center beam on the phosphor screen to provide good beam convergence over the entire screen.

FIGS. 8A, 8B and 8C are explanatory views of still another example of magnetic pieces of a convergence correction device of the color cathode ray tube according to the present invention, the same reference numerals as those in FIGS. 6A to 6C correspond to the same components, FIG. 8A is a front view as viewed from the side of the phosphor screen, FIG. 8B is a side view perpendicular to the in-line direction of the three electron beams, and FIG. 8C is a bottom view as viewed from the bottom side of the magnetic pieces of FIG. 8A. A plane shape of the magnetic pieces of the convergence correction device 39 is substantially the same as that in FIGS. 6A to 6C. The axial thickness ds of the magnetic pieces 39-1, 39-4 disposed on the neck wall sides of the side beams 10S, respectively, is made larger than the axial thickness dc of the magnetic pieces 39-2, 39-3 disposed on opposite sides of the center beam.

With this configuration, similar effects to those explained in FIGS. 6A to 6C are obtained.

FIGS. 9A, 9B and 9C are explanatory views of another example of magnetic pieces of a convergence correction device of the color cathode ray tube according to the present invention, the same reference numerals as those in FIGS. 7A to 7C correspond to the same components, FIG. 9A is a front view as viewed from the side of the phosphor screen, FIG. 9B is a side view perpendicular to the in-line direction of the three electron beams, and FIG. 9C is a bottom view as viewed from the bottom side of the magnetic pieces of FIG. 9A.

A plane shape of the magnetic pieces of the convergence correction device 39 is substantially the same as that in FIGS. 7A to 7C. An axial thickness ds of the magnetic pieces 39-1, 39-4 disposed on the neck wall sides of the side beams 10S is made larger than an axial thickness dc of the magnetic pieces 39-2, 39-3 disposed on opposite sides of the center beam.

With this configuration, similar effects to those explained in FIGS. 7A to 7C are obtained.

FIGS. 10A, 10B and 10C are explanatory views of another example of magnetic pieces of a convergence correction device of the color cathode ray tube according to the present invention, the same reference numerals as those in the above embodiments correspond to the same components, FIG. 10A is a front view as viewed from the side of the phosphor screen, FIG. 10B is a side view perpendicular to the in-line direction of the three electron beams, and FIG. 10C is a bottom view as viewed from the bottom side of the magnetic pieces of FIG. 10A.

A plane shape of the magnetic pieces of the convergence correction device 39 is substantially the same as that in FIGS. 8A to 8C. The axial thickness ds of the magnetic pieces 39-1, 39-4 disposed on the neck wall sides of the side beams, and the axial thickness dc on the center beam side are made greater than an axial thickness dC' on the side beam side of the magnetic pieces 39-2, 39-3 disposed on opposite sides of the center beam.

With this configuration, the horizontal deflection sensitivity of the center beam is enhanced, and the horizontal deflection sensitivity of the side beams is decreased. The raster size of the side beam coincides with that of the center beam to provide good beam convergence over the entire screen.

Figure 11:
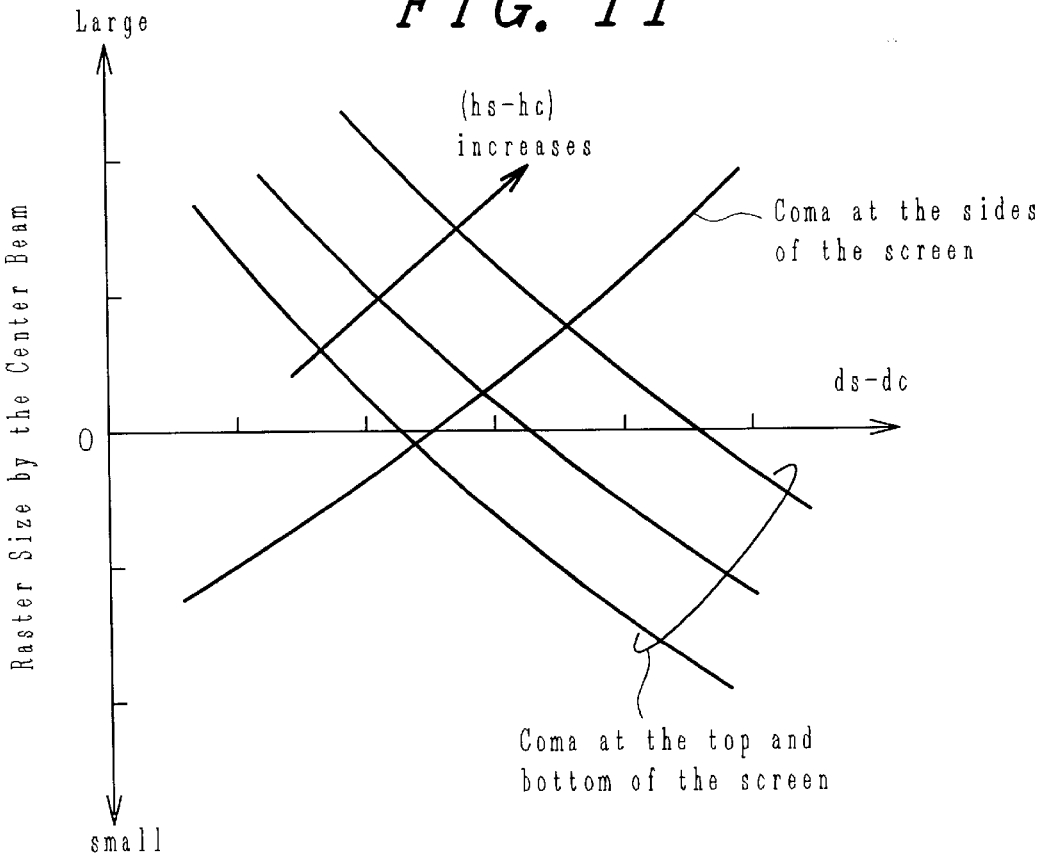
FIG. 11 is an explanatory view illustrating the correction of coma at the top, the bottom and the sides of the phosphor screen by the convergence correction device according to the present invention as the changes of the raster size created by the center beam.

FIG. 11 is an explanatory view showing the correction method of coma at the top, bottom and sides by the convergence correction devices according to the present invention as the changes of the raster size (at the top, bottom and sides) of the center beam. (ds−dc) is plotted as abscissas and the raster size at the top, the bottom and the sides of the center beam as ordinates.

Figure 12:
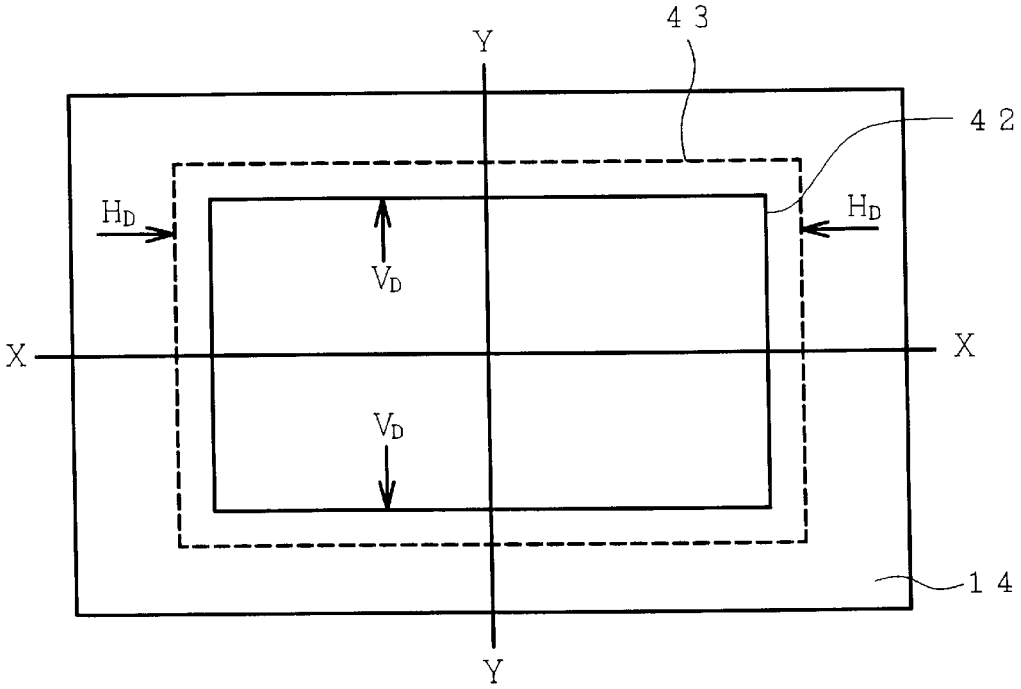
FIG. 12 is an explanatory view of the raster created on the phosphor screen.

FIG. 12 is an explanatory view of rasters formed on the screen. Reference numeral 14 designates a panel portion formed thereon with a phosphor screen, 42 a raster of a center beam (green beam), and 43 a raster of side beams (red and blue beams).

A method of correcting coma caused by the deflection magnetic field indicated in FIG. 11 will be described with reference to FIG. 12.

As shown in FIG. 11, when a difference (ds−dc) between the axial length ds of the side pieces 39-1*b*, 39-4*b* of the magnetic pieces 39-1, 39-4, respectively, of the convergence correction device in FIG. 6A to FIG. 10C and the axial length dc of bases 39-1*a*, 39-4*a* of the magnetic pieces 39-1, 39-4, and the magnetic pieces 39-2, 39-3 is made large, the horizontal coma, (in the x—x direction, or the HD direction) of the center beam increases, and the vertical coma (in the Y—Y direction, or the VD direction) tends to decrease Further, when a difference (hs−hc) between the distance hs between the magnetic pole tips at the top and the bottom on opposite sides of the in-line direction of the outer magnetic pieces 39-1, 39-4 associated with the side beams 10S and the distance hc between the magnetic pole tips at the top and the bottom on opposite sides of the in-line direction of the inner magnetic pieces 39-2, 39-3 associated with both of the center and side beams 10C and 10S is made larger, the vertical coma changes in a region where the raster size of the center beam is large, as shown in FIG. 11.

As described above, the horizontal and vertical comae can be corrected by choosing the differences (ds−dc) and (hs−hc), to achieve the convergence of three beam spots formed on the screen.

Figures 21A, 21B, 21C:
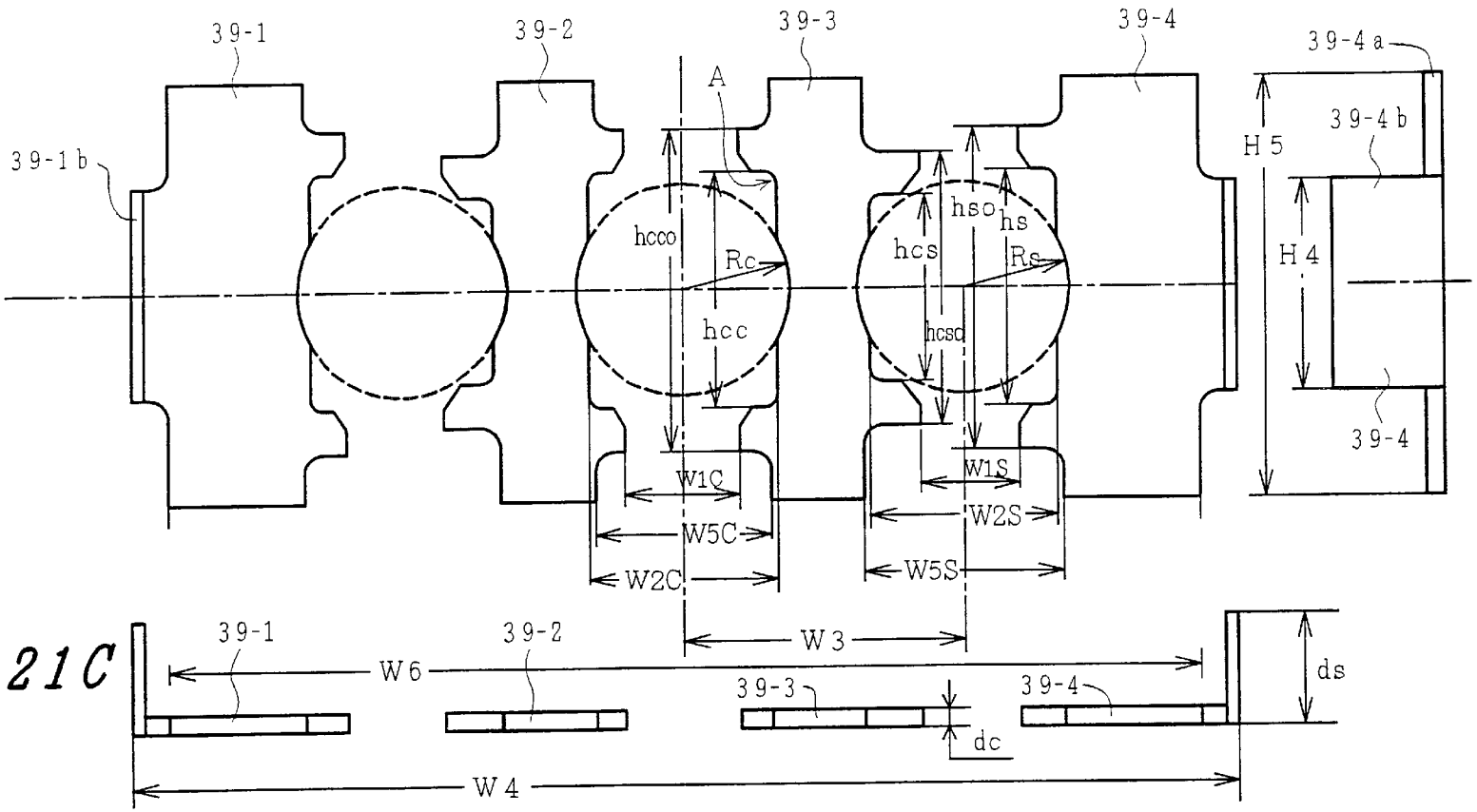
FIGS. 21A to 21C show the physical dimensions of the magnetic pieces for explaining numerical examples of the present invention, FIG. 21A being a front view as viewed from the side of the phosphor screen, FIG. 21B being a side view perpendicular to the in-line direction of the three in-line beams, FIG. 21C being a bottom view of the magnetic pieces viewed from the bottom side of FIG. 21A.

As numerical examples of the present invention in connection with the convergence correction device similar to FIGS. 6A–6C and 7A–7C, the shapes are shown in FIGS. 21A–21C and their dimensions are shown in Table 1 which are normalized by a spacing between the side beam and the center beam, a so-called "S" value in the range of 5.5 mm to 7.0 mm, in a color cathode ray tube having a neck portion of 29 mm in diameter. These can be applicable to cathode ray tubes having a neck portion of other than 29 mm in diameter and an "S" value in other ranges.

This can be summarized as follows. The deflection aberration caused by the vertical deflection can be corrected

TABLE 1

| | |
|---|---|
| W1C = 0.07–0.55 | RC = 0.07–0.45 |
| W1S = 0.07–0.55 | RS = 0.07–0.45 |
| W2C = 0.21–0.73 | dc = 0.01–0.55 |
| W2S = 0.21–0.73 | ds = 0.04–1.8 |
| W3 = 0.64–1.20 | hcs = 0.11–1.0 |
| W4 = 2.4–4.4 | hcso = 0.29–2.7 |
| W5C = 0.07–0.73 | hs = 0.14–1.1 |
| W5S = 0.07–1.1 | hso = 0.29–2.7 |
| W6 = 2.4–4.2 | H4 = 0.29–3.1 |
| hcc = 0.14–1.1 | H5 = 0.43–3.1 |
| hcco = 0.29–1.8 | |

by modifying a barrel-shaped magnetic deflection field distribution for vertical deflection locally toward a pincushion-shaped magnetic field distribution. The curvature of line of magnetic force can be adjusted by the amount of cutouts in a portion A in FIG. 21A. The decrease in the magnetic flux density caused by the provision of the cutout at the portion A can be compensated for by increasing the dimension dc. The vertical deflection sensitivity of the center electron beam can be increased by reducing the dimensions hcc and hcco, that is, the vertical coma correction of the convergence can be made. Similar control can be made by adjustment of W5C and H5. The above correction can be also applied to the side electron beams, but the action is the reverse of the case of the center electron beam. Further, in the case where the vertical deflection magnetic field has a barrel-shaped magnetic field distribution, the side electron beams are subjected to the right-left asymmetric deflection aberration and to correct this, the dimension hs is made larger than the dimension hcs.

The deflection aberration caused by the horizontal deflection can be corrected by modifying a pincushion-shaped magnetic deflection field distribution for horizontal deflection locally toward a barrel-shaped magnetic field distribution. The horizontal deflection sensitivity of the center electron beam can be reduced by reducing the dimension hcc and increasing the dimensions hcco and H5, and the control of the horizontal coma of the convergence can be made. Similar control can be applicable to the side electron beams, but the action is the reverse of the case of the center electron beam. The increase in the dimensions W4, W6, dc and ds can decrease the sensitivity of deflection of the electron beam from the side electron gun on the left side toward the right side of the screen, and the sensitivity of deflection of the electron beam from the side electron gun on the right side toward the left side of the screen.

In the above-described manner, it is possible to sufficiently correct the vertical coma, horizontal coma and right-left asymmetric deflection coma of side electron beams.

Figure 13:
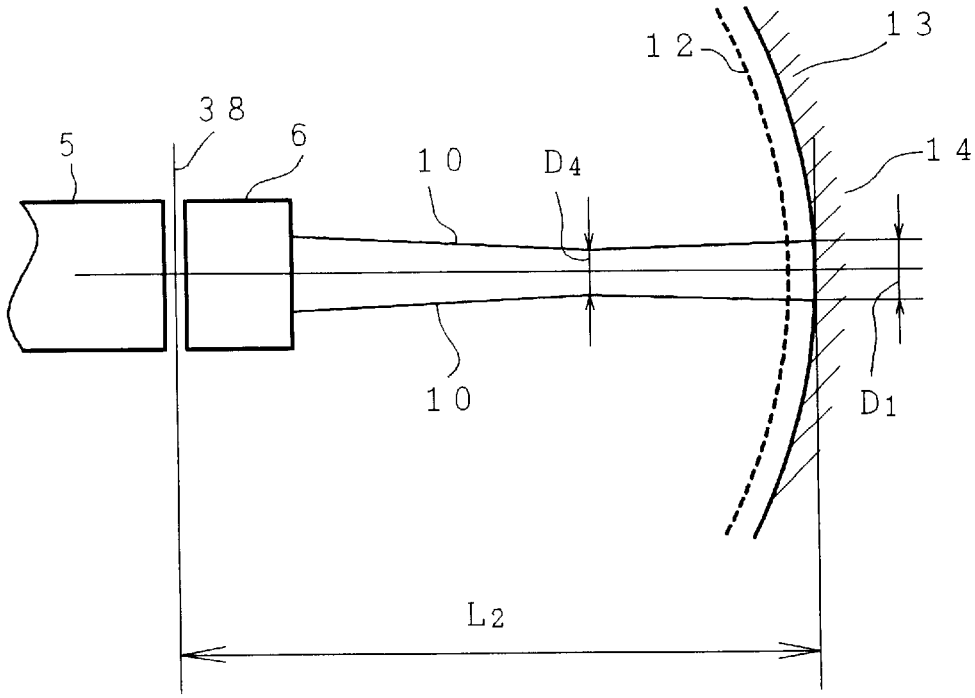
FIG. 13 is a schematic view showing the state of an electron beam between a main lens of an electron gun and a phosphor screen.

FIG. 13 is a schematic view showing the state of an electron beam in the way between a main lens of an electron gun and a phosphor screen. Reference numeral 5 designates a focus electrode, 6 an anode, 10 an electron beam, 13 a phosphor screen, 14 a panel portion, and 38 a main lens. A space between the anode 6 and the phosphor screen 13 is field-free and called a drift space.

The electron beam 10 subjected to focusing action by the main lens 38 moves toward the phosphor screen 10 and continues to be focused further. During this travel of the electrons, a diverging force is also exerted on the electrons by charges of the electrons themselves within the electron beam, that is, space charge repulsion. The electron beam is focused into a beam of the minimum diameter D4 on the way to the phosphor screen, is spread again by the diverging force of the space charge repulsion prevailing over the focusing action by the main lens and forms a beam spot of a diameter D1 larger than D4 on the phosphor screen.

Figure 14:
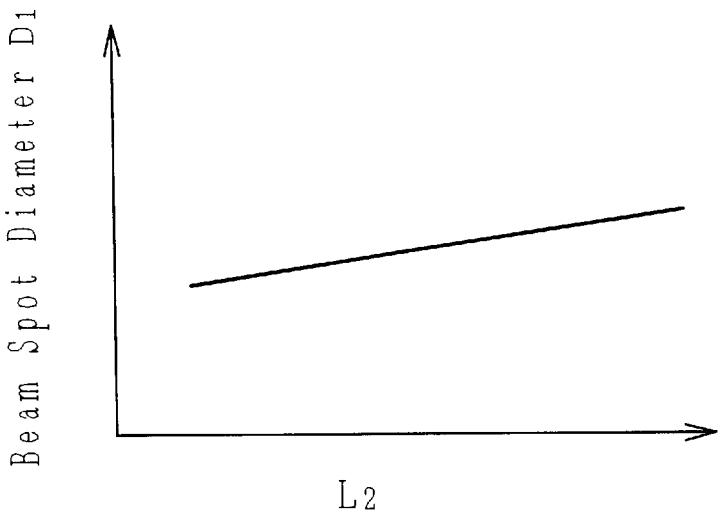
FIG. 14 is an explanatory view of the relationship of an electron beam spot diameter with respect to the distance between the main lens and the phosphor screen.

FIG. 14 is an explanatory view of the relationship of an electron beam spot diameter versus the distance between the main lens and the phosphor screen. The phenomenon explained in connection with FIG. 13 becomes pronounced as a distance L2 between the main lens and the phosphor screen increased as shown in FIG. 14 and deteriorates resolution.

Further, as the distance L2 increases, the imaging magnification for projecting a virtual object in the vicinity of the cathode of the electron gun onto the phosphor screen increases, the diameter of the spot formed on the phosphor screen 13 increases and deteriorates the resolution, where the remainder of the electron gun is the same in construction. For the aforementioned two reasons, the shortening of the distance between the main lens and the phosphor screen improves resolution at the center of the phosphor screen.

Generally, in the cathode ray tube, the diameter of the electron beam is maximized in the vicinity of the main lens of the electron gun. The larger the diameter of the electron beam becomes, the more susceptible it is to the influence of the deflection magnetic field and the more the deflection defocusing is.

Figure 15:
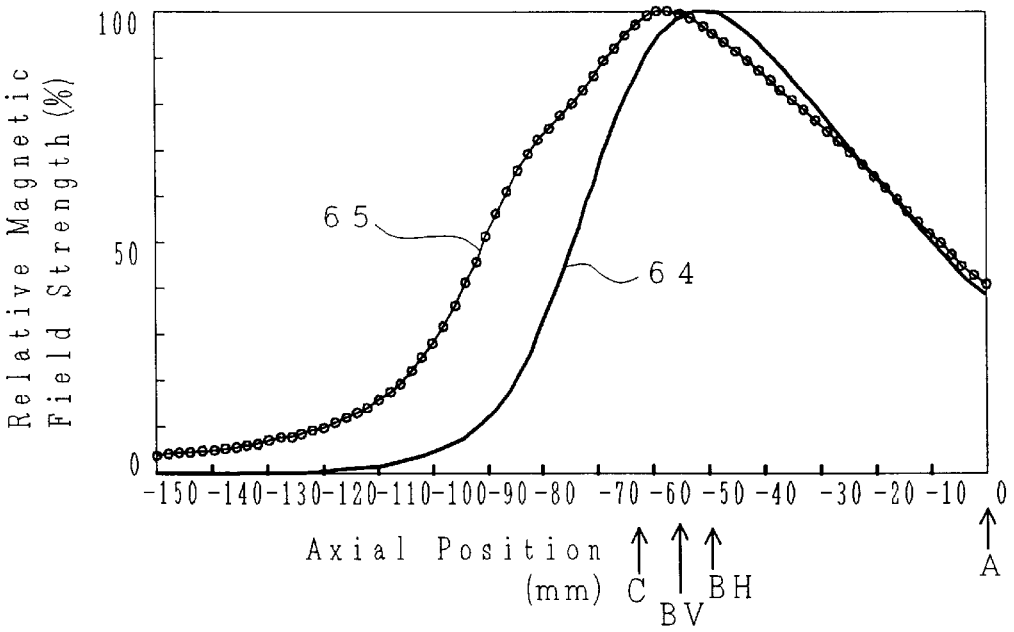
FIG. 15 shows an actual magnetic field distribution generated by the deflection device.
Figure 16:
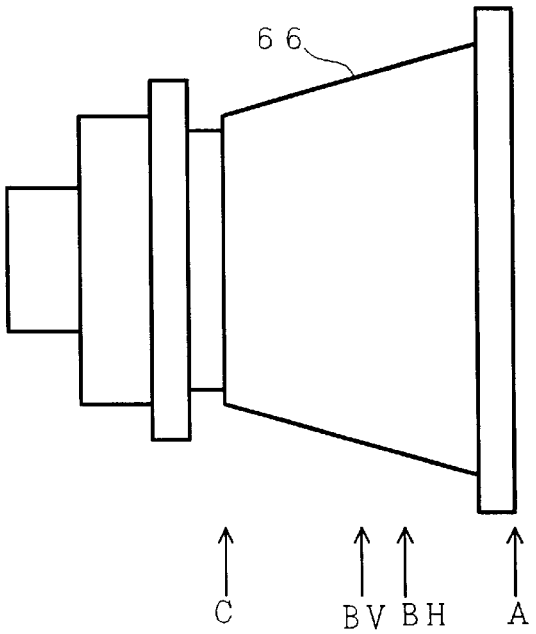
FIG. 16 is a side view of the deflection device generating the magnetic field distribution of FIG. 15.

FIG. 15 shows an actual magnetic field distribution generated by the deflection device, and FIG. 16 is a side view of the deflection device, wherein A designates a reference point for measuring magnetic fields, BH a position having the maximum magnetic flux density 64 for deflection in a direction of a scanning line, BV a position having the maximum magnetic flux density 65 for deflection in a direction perpendicular to the scanning line, and C an end of the core of magnetic material on the side remote from the phosphor screen of the cathode ray tube, in a coil for generating a deflection magnetic field.

Even in the conventional cathode ray tube, it is possible to improve resolution at the center of the phosphor screen by shortening the distance between the main lens an the phosphor screen. However, when the deflection magnetic field shown in FIG. 15 is moved closer to the main lens, resolution at the periphery of the screen is degraded severely due to the increase in deflection defocusing. Therefore, the distance between the main lens and the phosphor screen could not be shortened in actual cathode ray tubes.

On the other hand, according to the present invention, since the influence of the deflection magnetic field is allowed for in the correction by the convergence correction device disposed in the deflection magnetic field, the distance between the main lens and the phosphor screen can be shortened to improve resolution at the center of the phosphor screen.

As described above, when the convergence correction device constituted by the magnetic pieces is provided in the deflection magnetic field generated by the deflection device to correct the deflection aberration related to the deflection amount, the beam convergence over the entire screen is achieved by modifying the deflection magnetic field locally by using the magnetic pieces configured so as to adjust the deflection amount of the center electron beam and the side electron beams individually, and even if the deflection yoke having no coma correction function is used, the convergence can be controlled over the entire phosphor screen.

Further, it is possible to provide a cathode ray tube which can improve the uniformity of resolution over the entire phosphor screen by coma correction related to the deflection amount, can shorten the distance between the phosphor screen and the main lens to suppress the influence of repulsion of the space charge and to improve resolution at the center of the phosphor screen, and can not only shorten the overall length of the color cathode ray tube but also reduces appearance of moire pattern.

FIGS. 17A to 17D are explanatory views of an example of an image display apparatus into which a cathode ray tube of the present invention is incorporated.

Figure 17A:
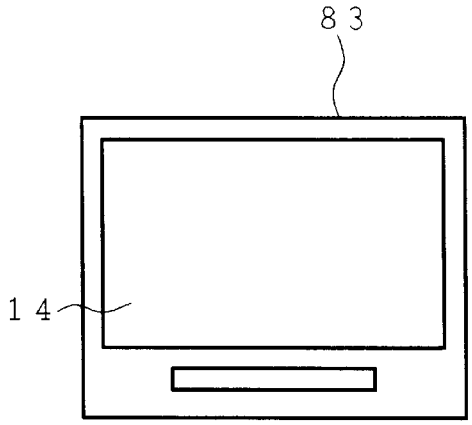
FIGS. 17A to 17B are explanatory views of an example of an image display apparatus incorporating the color cathode ray tube according to the present invention.
Figure 17B:
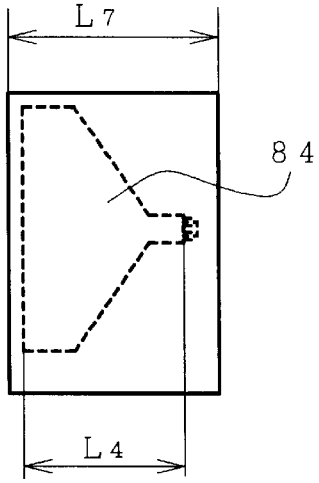
Figure 17C:
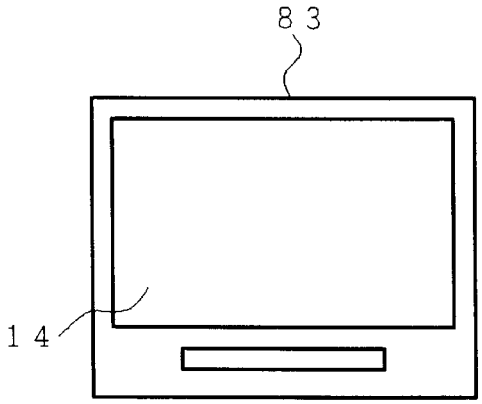
FIG. 17C (PRIOR ART)
FIGS. 17C to 17D are explanatory views showing a conventional image display apparatus.
Figure 17D:
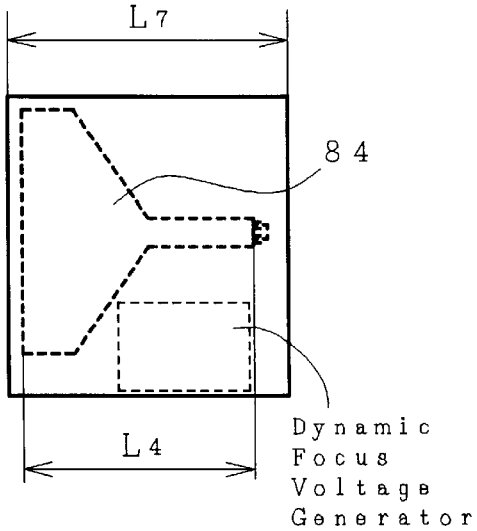
FIG. 17D (PRIOR ART)
Figure 18:
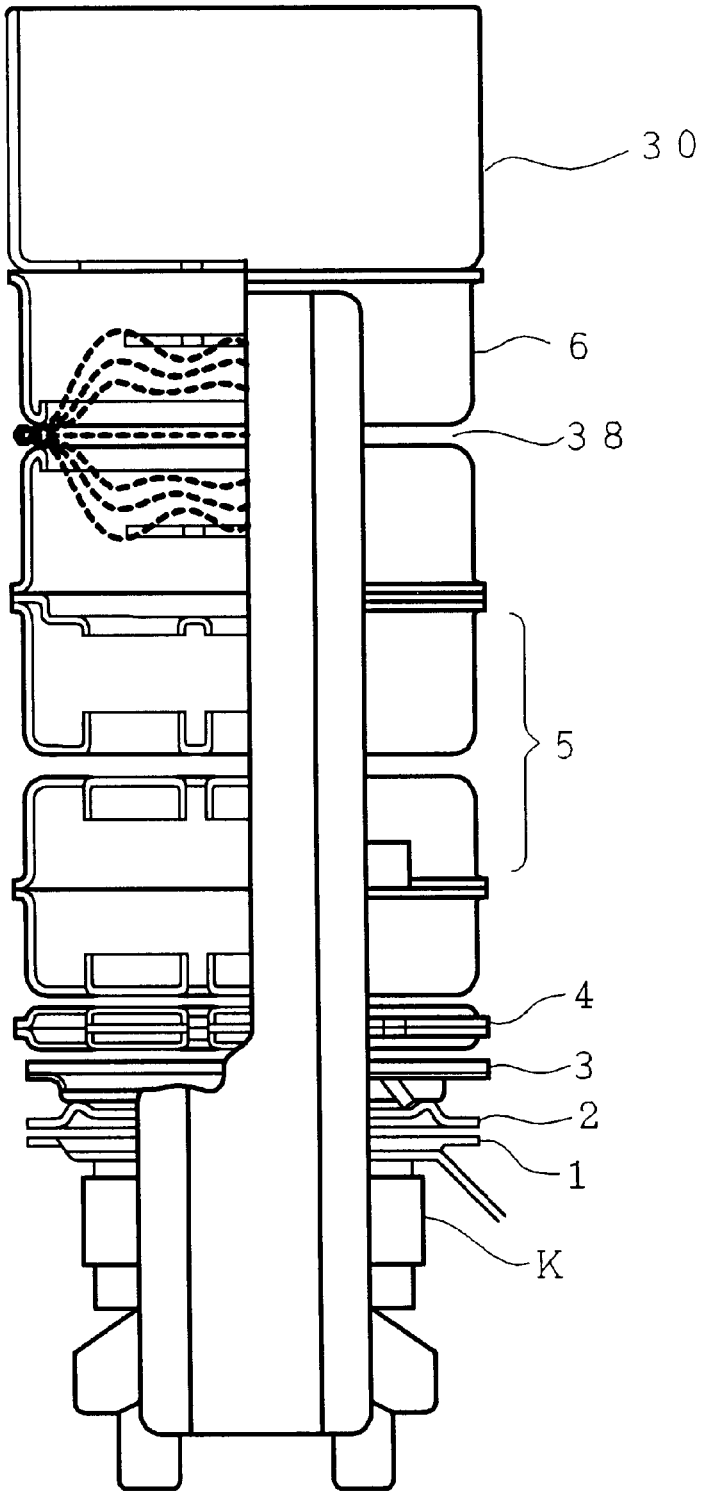
FIG. 18 is a fragmentary sectional view showing an example of an electron gun for a color cathode ray tube using three in-line electron beams.
Figure 19A:
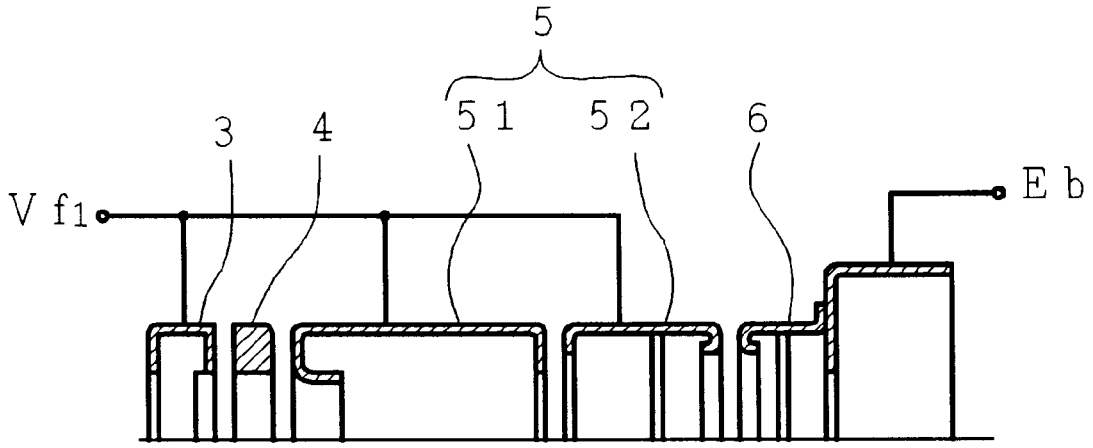
FIGS. 19A and 19B are schematic sectional views of main parts for comparison of the construction of electron guns depending upon the manner of applying focus voltages, FIG. 19A showing a fixed focus voltage type, FIG. 19B showing a dynamic focus voltage type.
Figure 19B:
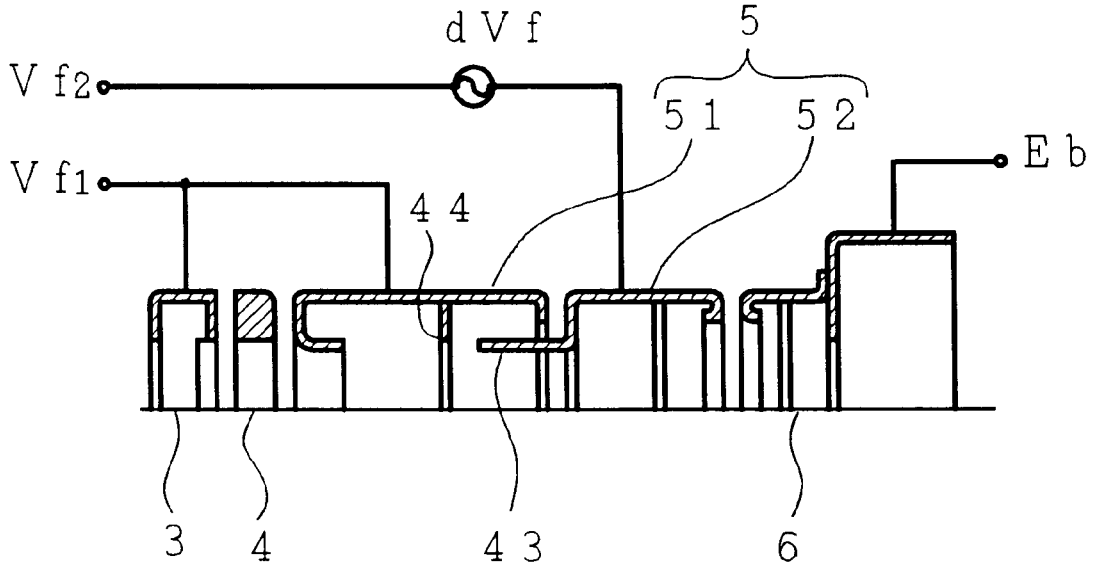
Figure 20A:
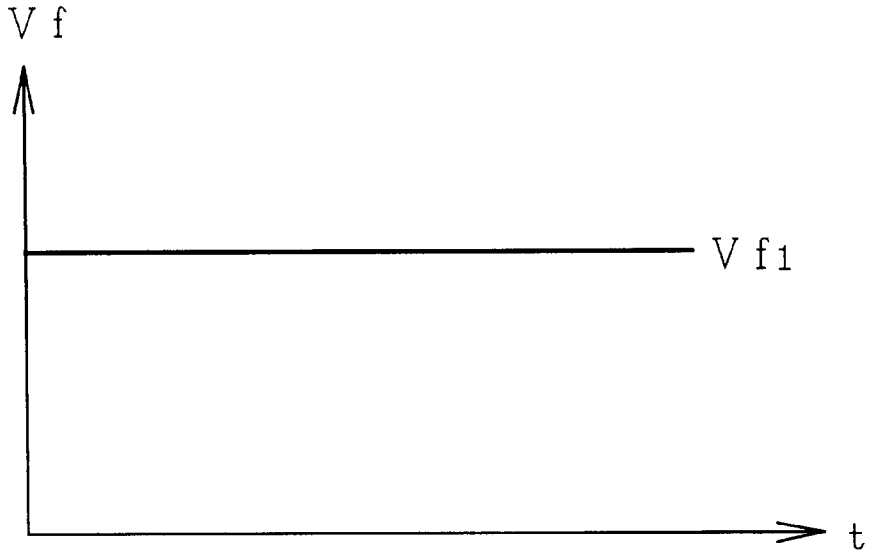
FIGS. 20A and 20B are explanatory views of focus potentials applied to the electron guns shown in FIGS. 19A and 19B, FIG. 20A showing a focus voltage waveform for the fixed focus voltage type electron gun, FIG. 20B showing a focus voltage waveform for the dynamic focus voltage type electron gun.
Figure 20B:
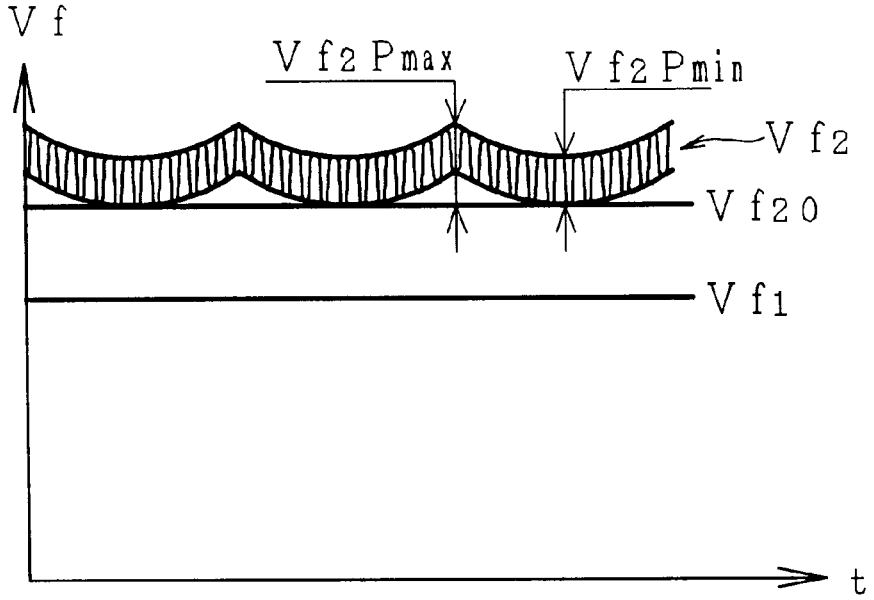

FIGS. 17A and 17B are a front view and a side view, respectively, of the image display apparatus employing the cathode ray tube of the present invention, and FIGS. 17C and 17D are a front view and a side view, respectively, the image display apparatus employing a conventional cathode ray tube.

In FIGS. 17B and 17D, a depth L7 of a cabinet 83 of the image display apparatus employing the cathode ray tube of the present invention is shorter than that employing the prior art cathode ray tube and save the space for installation.

The depth L7 can be shortened because the main lens of the electron gun of the cathode ray tube can be moved closer to the deflection yoke and the overall length L4 of the cathode ray tube can be shortened by correcting coma caused by the magnetic deflection field with provision of the convergence correction device constituted by the magnetic pieces in the deflection magnetic field to locally modify the deflection magnetic field.

As described above, according to the present invention, it is possible to provide an image display apparatus which can display a larger amount of information, display a flicker-less high quality, and is short in depth of the cabinet.

As described above, according to the present invention, there is provided a color cathode ray tube of the type having at least an electron gun using three in-line electron beams comprising a plurality of electrodes, a deflection device, a color selection electrode, and a phosphor screen, in which a convergence correction device constituted by magnetic pieces is disposed in a deflection magnetic field generated by the deflection device to correct deflection aberration, and the magnetic pieces modify the deflection magnetic field locally to correct coma caused by the deflection magnetic field such that the respective deflection amounts of the center and side electron beams are adjusted individually. The color cathode ray tube of the present invention can achieve a good beam convergence over the entire phosphor screen even when it is operated in combination with a deflection yoke having no coma-correcting function.

Further, it is possible to provide a cathode ray tube which can improve the uniformity of the resolution over the entire phosphor screen with coma correction related to the deflection amount, improve resolution at the center of the phosphor screen by shortening the distance between the phosphor screen and the main lens and resultant suppression of the influence of repulsion of the space charge, and not only make possible the shortening of the overall length of the color cathode ray tube, but also reduce appearance of moire patterns.

Further, it is possible to provide an image display apparatus which can display a large amount of information, display a flicker-less high quality image, and is short in depth of the cabinet.

What is claimed is:

1. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion;

an electron gun comprising a plurality of electrodes for generating and focusing three in-line electron beams and housed within said neck portion;

a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device;

said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction; and said plurality of magnetic pieces being configured so as to locally modify said magnetic deflection fields and to make three rasters formed on said phosphor screen by said three electron beams coincident with each other; and said first pair of magnetic pieces having a portion of an axial length greater than an axial length of said second pair of magnetic pieces, and said axial lengths being measured in a plane containing said in-line direction and a longitudinal axis of said color cathode ray tube.

2. A color cathode ray tube according to claim 1, wherein one of said first pair of magnetic pieces opposes one of said second pair of magnetic pieces, another of said first pair of magnetic pieces opposes another of said second pair of magnetic pieces, tips of said one of said first pair of magnetic pieces are displaced outwardly from tips of said one of said second pair of magnetic pieces in a direction perpendicular to said in-line direction, said tips of said one of said first pair and said tips of said one of said second pair opposing each other, respectively, and tips of said another of said first pair of magnetic pieces are displaced outwardly from tips of said another of said second pair of magnetic pieces in a direction perpendicular to said in-line direction, said tips of said another of said first pair and said tips of said another of said second pair opposing each other, respectively.

3. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion;

an electron gun comprising a plurality of electrodes for generating and focusing three in-line electron beams and housed within said neck portion;

a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device;

said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction;

said plurality of magnetic pieces being configured so as to locally modify said magnetic deflection fields and to make three rasters formed on said phosphor screen by said three electron beams coincident with each other;

one of said first pair of magnetic pieces opposing one of said second pair of magnetic pieces, another of said first pair of magnetic pieces opposing another of said second pair of magnetic pieces, tips of said one of said first pair of magnetic pieces being displaced outwardly from tips of said one of said second pair of magnetic pieces in a direction perpendicular to said in-line direction, said tips of said one of said first pair and said tips of said one of said second pair opposing each other, respectively, and tips of said another of said first pair of magnetic pieces being displaced outwardly from tips of said another of said second pair of magnetic pieces in a direction perpendicular to said in-line direction, said tips of said another of said first pair and said tips of said another of said second pair opposing each other, respectively.

4. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion;

an electron gun comprising a plurality of electrodes for generating and focusing three in-line electron beams and housed within said neck portion;

a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device;

said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction; and said plurality of magnetic pieces being configured so as to locally modify said magnetic deflection fields and to make three rasters formed on said phosphor screen by said three electron beams coincident with each other;

said first pair of magnetic pieces having a portion of an axial length greater than a thickness of said second pair of magnetic pieces; and said axial length being measured in a plane containing said in-line direction and a longitudinal axis of said color cathode ray tube.

5. A color cathode ray tube according to claim 4, wherein one of said first pair of magnetic pieces opposes one of said second pair of magnetic pieces, another of said first pair of magnetic pieces opposes another of said second pair of magnetic pieces, tips of said one of said first pair of magnetic pieces are displaced outwardly from tips of said one of said second pair of magnetic pieces in a direction perpendicular to said in-line direction, said tips of said one of said first pair and said tips of said one of said second pair opposing each other, respectively, and tips of said another of said first pair of magnetic pieces are displaced outwardly from tips of said another of said second pair of magnetic pieces in a direction perpendicular to said in-line direction, said tips of said another of said first pair and said tips of said another of said second pair opposing each other, respectively.

6. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion;

an electron gun comprising a plurality of electrodes for generating and focusing three in-line electron beams and housed within said neck portion;

a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device;

said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction; and said plurality of magnetic pieces being configured so as to locally modify said magnetic deflection fields and to make three rasters formed on said phosphor screen by said three electron beams coincident with each other; and said second pair of magnetic pieces being thinner on a side-electron beam side thereof than on a center-electron beam side thereof.

7. A color cathode ray tube according to claim 6, wherein one of said first pair of magnetic pieces opposes one of said second pair of magnetic pieces, another of said first pair of magnetic pieces opposes another of said second pair of magnetic pieces, tips of said one of said first pair of magnetic pieces are displaced outwardly from tips of said one of said second pair of magnetic pieces in a direction perpendicular to said in-line direction, said tips of said one of said first pair and said tips of said one of said second pair opposing each other, respectively, and tips of said another of said first pair of magnetic pieces are displaced outwardly from tips of said another of said second pair of magnetic pieces in a direction perpendicular to said in-line direction, said tips of said another of said first pair and said tips of said another of said second pair opposing each other, respectively.

8. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion;

an electron gun comprising a plurality of electrodes for generating and focusing three in-line electron beams and housed within said neck portion;

a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device;

said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction; and said plurality of magnetic pieces being configured so as to locally modify a pincushion-shaped magnetic deflection field for horizontal deflection generated by said deflection device toward a barrel-shaped magnetic field and so as to locally modify a barrel-shaped magnetic deflection field for vertical deflection generated by said deflection device toward a pincushion-shaped magnetic field; and said first pair of magnetic pieces having a portion having an axial length greater than an axial length of said second pair of magnetic pieces, and said axial lengths being measured in a plane containing said in-line direction and a longitudinal axis of said color cathode ray tube.

9. A color cathode ray tube according to claim 8, wherein one of said first pair of magnetic pieces opposes one of said second pair of magnetic pieces, another of said first pair of magnetic pieces opposes another of said second pair of magnetic pieces, tips of said one of said first pair of magnetic pieces are displaced outwardly from tips of said one of said second pair of magnetic pieces in a direction perpendicular to said in-line direction, said tips of said one of said first pair and said tips of said one of said second pair opposing each other, respectively, and tips of said another of said first pair of magnetic pieces are displaced outwardly from tips of said another of said second pair of magnetic pieces in a direction perpendicular to said in-line direction, said tips of said another of said first pair and said tips of said another of said second pair opposing each other, respectively.

10. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion;

an electron gun comprising a plurality of electrodes for generating and focusing three in-line electron beams and housed within said neck portion;

a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device;

said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction;

said plurality of magnetic pieces being configured so as to locally modify a pincushion-shaped magnetic deflection field for horizontal deflection generated by said deflection device toward a barrel-shaped magnetic field and so as to locally modify a barrel-shaped magnetic deflection field for vertical deflection generated by said deflection device toward a pincushion-shaped magnetic field;

one of said first pair of magnetic pieces opposing one of said second pair of magnetic pieces, another of said first pair of magnetic pieces opposing another of said second pair of magnetic pieces, tips of said one of said first pair of magnetic pieces being displaced outwardly from tips of said one of said second pair of magnetic pieces in a direction perpendicular to said in-line direction, said tips of said one of said first pair and said tips of said one of said second pair opposing each other, respectively, and tips of said another of said first pair of magnetic pieces being displaced outwardly from tips of said another of said second pair of magnetic pieces in a direction perpendicular to said in-line direction, said tips of said another of said first pair and said tips of said another of said second pair opposing each other, respectively.

11. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion;

an electron gun comprising a plurality of electrodes for generating and focusing three in-line electron beams and housed within said neck portion;

a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device;

said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction; and said plurality of magnetic pieces being configured so as to locally modify a pincushion-shaped magnetic deflection field for horizontal deflection generated by said deflection device toward a barrel-shaped magnetic field and so as to locally modify a barrel-shaped magnetic deflection field for vertical deflection generated by said deflection device toward a pincushion-shaped magnetic field;

said first pair of magnetic pieces having a portion of an axial length greater than a thickness of said second pair of magnetic pieces; and said axial length being measured in a plane containing said in-line direction and a longitudinal axis of said color cathode ray tube.

12. A color cathode ray tube according to claim 5, wherein one of said first pair of magnetic pieces opposes one of said second pair of magnetic pieces, another of said first pair of magnetic pieces opposes another of said second pair of magnetic pieces, tips of said one of said first pair of magnetic pieces are displaced outwardly from tips of said one of said second pair of magnetic pieces in a direction perpendicular to said in-line direction, said tips of said one of said first pair and said tips of said one of said second pair opposing each other, respectively, and tips of said another of said first pair of magnetic pieces are displaced outwardly from tips of said another of said second pair of magnetic pieces in a direction perpendicular to said in-line direction, said tips of said another of said first pair and said tips of said another of said second pair opposing each other, respectively.

13. A color cathode ray tube including a vacuum envelope comprising a panel portion, a neck portion, and a funnel portion connecting said panel portion and said neck portion;

a phosphor screen on an inner surface of said panel portion;

a shadow mask suspended closely spaced from said phosphor screen in said panel portion;

an electron gun comprising a plurality of electrodes for generating and focusing three in-line electron beams and housed within said neck portion;

a deflection device mounted around a transition area between said funnel portion and said neck portion for deflecting said three electron beams in horizontal and vertical directions; and a convergence correction device comprising a plurality of magnetic pieces positioned on opposite sides of each of said three electron beams in an in-line direction of said three electron beams in magnetic deflection fields generated by said deflection device;

said plurality of magnetic pieces including a first pair of magnetic pieces positioned on a neck wall side of each of side electron beams of said three electron beams in said in-line direction and a second pair of magnetic pieces positioned on opposite sides of a center electron beam of said three electron beams in said in-line direction; and said plurality of magnetic pieces being configured so as to locally modify a pincushion-shaped magnetic deflection field for horizontal deflection generated by said deflection device toward a barrel-shaped magnetic field and so as to locally modify a barrel-shaped magnetic deflection field for vertical deflection generated by said deflection device toward a pincushion-shaped magnetic field; and said second pair of magnetic pieces being thinner on a side-electron beam side thereof than on a center-electron beam side thereof.

14. A color cathode ray tube according to claim 13, wherein one of said first pair of magnetic pieces opposes one of said second pair of magnetic pieces, another of said first pair of magnetic pieces opposes another of said second pair of magnetic pieces, tips of said one of said first pair of magnetic pieces are displaced outwardly from tips of said one of said second pair of magnetic pieces in a direction perpendicular to said in-line direction, said tips of said one of said first pair and said tips of said one of said second pair opposing each other, respectively, and tips of said another of said first pair of magnetic pieces are displaced outwardly from tips of said another of said second pair of magnetic pieces in a direction perpendicular to said in-line direction, said tips of said another of said first pair and said tips of said another of said second pair opposing each other, respectively.

* * * * *